US012539953B1

(12) United States Patent
Belter

(10) Patent No.: US 12,539,953 B1
(45) Date of Patent: Feb. 3, 2026

(54) CONFIGURABLE SHIFT AND THROTTLE MECHANISM FOR TILLER OF MARINE DRIVE

(71) Applicant: Brunswick Corporation, Mettawa, IL (US)

(72) Inventor: David J. Belter, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 651 days.

(21) Appl. No.: 18/047,360

(22) Filed: Oct. 18, 2022

(51) Int. Cl.
*B63H 21/21* (2006.01)

(52) U.S. Cl.
CPC ..... *B63H 21/213* (2013.01)

(58) Field of Classification Search
CPC . B63H 21/21; B63H 21/213; B63H 2021/216
USPC ..... 440/84, 85, 86
See application file for complete search history.

(56) References Cited

U.S. PATENT DOCUMENTS

| | | | |
|---|---|---|---|
| 1,854,196 | A | 4/1932 | Irgens |
| 2,363,854 | A | 11/1944 | Bierenfeld |
| D188,325 | S | 7/1960 | Brown |
| 3,018,754 | A | 1/1962 | Snyder et al. |
| 3,636,911 | A | 1/1972 | Piazza |
| 3,693,576 | A | 9/1972 | Driscoll |
| 3,865,334 | A | 2/1975 | Wair, Jr. |
| 3,955,527 | A | 5/1976 | Holtermann |
| 3,961,595 | A | 6/1976 | Meyer |
| D246,853 | S | 1/1978 | Berchem |
| 4,071,002 | A | 1/1978 | Frahm |
| 4,295,835 | A | 10/1981 | Mapes et al. |
| 4,318,699 | A | 3/1982 | Wenstadt et al. |
| 4,331,431 | A | 5/1982 | Estes |
| D272,357 | S | 1/1984 | Hall et al. |
| 4,447,214 | A | 5/1984 | Henrich |
| D276,811 | S | 12/1984 | Wolfe |

(Continued)

FOREIGN PATENT DOCUMENTS

| | | |
|---|---|---|
| AU | 2019100942 | 9/2019 |
| CA | 2367740 | 7/2002 |

(Continued)

OTHER PUBLICATIONS

Belter, Unpublished U.S. Appl. No. 18/047,360, filed Oct. 18, 2022, "Configurable Shift and Throttle Mechanism for Tiller of Marine Drive" (specification and drawings only).

(Continued)

*Primary Examiner* — Daniel V Venne
(74) *Attorney, Agent, or Firm* — Andrus Intellectual Property Law, LLP

(57) ABSTRACT

A tiller system for a marine drive having an electric motor is provided. The tiller system includes a tiller having a shift handle and a throttle grip configured to be rotated about a throttle axis to control a speed of the electric motor. The tiller system further includes a controller communicatively coupled to the throttle grip and the shift handle. The controller is configured to determine whether the tiller is in a separate handle mode or a throttle grip mode. Responsive to a determination that the tiller is in the throttle grip mode, the controller is configured to operate the electric motor such that a rotation of the throttle grip about the throttle axis controls a rotation direction of the electric motor.

27 Claims, 7 Drawing Sheets

(56) References Cited

U.S. PATENT DOCUMENTS 4,496,326 A 1/1985 Boda
4,504,778 A 3/1985 Evans
4,521,201 A 6/1985 Watanabe
4,582,493 A 4/1986 Toyohara
4,650,429 A 3/1987 Boda
4,701,141 A 10/1987 Sumigawa
D295,867 S 5/1988 Walsh
4,800,854 A 1/1989 Boda et al.
4,838,820 A 6/1989 Boda et al.
4,878,468 A 11/1989 Boda et al.
4,895,154 A 1/1990 Bartelt
4,897,061 A 1/1990 Koepsel et al.
4,911,665 A 3/1990 Hetzel
5,072,809 A 12/1991 Shibata
D323,508 S 1/1992 Hirshberg et al.
5,145,427 A 9/1992 Kawai et al.
D332,265 S 1/1993 Osumi
5,180,320 A 1/1993 Calamia et al.
D341,365 S 11/1993 Little et al.
D343,625 S 1/1994 Walthall
5,277,634 A 1/1994 Calamia et al.
5,340,342 A 8/1994 Boda et al.
D352,723 S 11/1994 DeBraal et al.
5,378,178 A 1/1995 Haman
D359,290 S 6/1995 Takeuchi
5,509,836 A 4/1996 Ogasawara et al.
5,540,606 A 7/1996 Strayhorn
D373,113 S 8/1996 Stringer
5,632,657 A 5/1997 Henderson
D380,478 S 7/1997 Robbins
D387,775 S 12/1997 Iekura
5,707,262 A 1/1998 Huntley et al.
5,756,949 A 5/1998 Sato
5,797,777 A 8/1998 Tsunekawa et al.
D412,911 S 8/1999 Iekura
5,967,866 A 10/1999 Willows et al.
D416,871 S 11/1999 Todd
D418,519 S 1/2000 Iekura
6,020,563 A 2/2000 Risk, Jr. et al.
D421,444 S 3/2000 Hatch et al.
D428,616 S 7/2000 Iekura
6,093,066 A 7/2000 Isogawa et al.
6,109,986 A 8/2000 Gaynor et al.
6,146,221 A 11/2000 Natsume
D438,493 S 3/2001 Mulliniks et al.
6,264,513 B1 7/2001 Marsh
6,264,516 B1 7/2001 McEathron et al.
D447,123 S 8/2001 Winkler
6,273,771 B1 8/2001 Buckley et al.
D448,037 S 9/2001 Westimayer et al.
6,352,456 B1 3/2002 Jaszewski et al.
D457,166 S 5/2002 Burmeister et al.
6,382,122 B1 5/2002 Gaynor et al.
D458,273 S 6/2002 Burmeister et al.
6,406,342 B1 6/2002 Walczak et al.
6,406,343 B2 6/2002 Kawai et al.
D460,459 S 7/2002 Hansen
D460,465 S 7/2002 Williams
D460,972 S 7/2002 Osumi
D462,363 S 9/2002 Burmeister et al.
D463,447 S 9/2002 Osumi et al.
D463,448 S 9/2002 Osumi et al.
D463,449 S 9/2002 Osumi
D463,800 S 10/2002 Osumi
D466,907 S 12/2002 Ohsumi
6,494,431 B1 12/2002 McCoy
D470,154 S 2/2003 Burmeister et al.
6,524,148 B2 2/2003 Yoshigasaki et al.
D474,480 S 5/2003 Zebley, Jr. et al.
D474,784 S 5/2003 Sanschagrin et al.
6,558,213 B1 5/2003 McGowan
D478,597 S 8/2003 Zebley, Jr.
6,648,703 B2 11/2003 McChesney et al.
6,663,450 B1 12/2003 Walczak et al.
D485,847 S 1/2004 Sanschagrin et al.
D485,848 S 1/2004 Sanschagrin et al.
D486,500 S 2/2004 Okamoto
D489,380 S 5/2004 Ohsumi et al.
D495,345 S 8/2004 Farlow et al.
D495,716 S 9/2004 Sanschagrin et al.
D497,370 S 10/2004 Katoh
D498,485 S 11/2004 Kuwae
D498,764 S 11/2004 Sanschagrin et al.
D500,056 S 12/2004 Young et al.
6,875,066 B2 4/2005 Wolaver
6,902,450 B2 6/2005 Ohtsuki et al.
6,914,202 B2 7/2005 Sugimoto et al.
7,001,231 B1 2/2006 Halley et al.
D517,096 S 3/2006 Landers et al.
7,090,551 B1 8/2006 Lokken et al.
D527,737 S 9/2006 Lekura
D528,128 S 9/2006 Sanschagrin et al.
D528,563 S 9/2006 Sanschagrin et al.
D531,639 S 11/2006 Okamoto
D531,640 S 11/2006 Okamoto
D536,704 S 2/2007 Iekura
D537,838 S 3/2007 Iekura
7,210,973 B2 5/2007 Sanschagri et al.
7,214,113 B2 5/2007 Kojima
D549,240 S 8/2007 Okamoto
7,267,592 B1 9/2007 Ingebritson et al.
D552,129 S 10/2007 Steinberg
D552,130 S 10/2007 Steinberg et al.
D560,050 S 1/2008 Tokach et al.
D563,907 S 3/2008 Badarello
D565,607 S 4/2008 Moen et al.
7,404,747 B2 7/2008 Shinde et al.
D578,274 S 10/2008 Tokach et al.
7,442,104 B2 10/2008 Okabe
7,455,558 B2 11/2008 Yander
D584,317 S 1/2009 Okamoto
D589,981 S 4/2009 Iekura
7,553,206 B2 6/2009 Hasegawa et al.
7,666,038 B2 2/2010 Yomo et al.
D611,062 S 3/2010 Okamoto
D611,063 S 3/2010 Okamoto
D611,501 S 3/2010 Vignau et al.
D611,502 S 3/2010 Vignau et al.
7,677,938 B2 3/2010 Wiatrowski et al.
7,704,110 B2 4/2010 Wiatrowski et al.
7,736,207 B2 6/2010 Vignau
D623,661 S 9/2010 Yamagishi et al.
D624,567 S 9/2010 Kelley
D626,975 S 11/2010 Ryczek et al.
D629,818 S 12/2010 Rummer et al.
D635,154 S 3/2011 Rummer et al.
7,895,959 B1 3/2011 Angel et al.
D635,586 S 4/2011 Okamoto
7,976,354 B2 7/2011 Kubota et al.
D643,440 S 8/2011 Dannenberg et al.
8,106,617 B1 1/2012 Holley
D655,308 S 3/2012 Steinberg
D655,320 S 3/2012 Hiraoka et al.
D657,400 S 4/2012 Loew
D660,323 S 5/2012 Hiraoka et al.
D660,614 S 5/2012 Palmeiri
D663,321 S 7/2012 Okamoto
8,257,122 B1 9/2012 Holley
8,651,906 B1 2/2014 Morton
D706,313 S 6/2014 Higashikawa et al.
D707,729 S 6/2014 Jackson et al.
D708,233 S 7/2014 Furuki et al.
D709,918 S 7/2014 Jones, Sr.
D712,931 S 9/2014 Matsumoto
D714,345 S 9/2014 Petit et al.
D715,333 S 10/2014 Jacobsthal et al.
D716,846 S 11/2014 Carter et al.
8,930,050 B2 1/2015 Garon et al.
D727,969 S 4/2015 Okamoto
9,004,964 B2 4/2015 Grez
D728,640 S 5/2015 Turner et al.
9,039,469 B1 5/2015 Calamia et al.
9,073,616 B1 7/2015 Wiegele et al.
9,109,616 B1 8/2015 Ballentine

(56) References Cited

U.S. PATENT DOCUMENTS

| | | | |
|---|---|---|---|
| D740,858 | S | 10/2015 | Dannenberg et al. |
| 9,180,950 | B1 | 11/2015 | Davenport et al. |
| 9,205,906 | B1 | 12/2015 | Eichinger |
| 9,216,805 | B1 | 12/2015 | Amerling et al. |
| D757,126 | S | 5/2016 | Vaninetti et al. |
| 9,359,059 | B1 | 6/2016 | Scherer, III et al. |
| 9,359,981 | B1 | 6/2016 | Waisanen et al. |
| 9,376,194 | B1 | 6/2016 | Jensen et al. |
| 9,422,045 | B2 | 8/2016 | Kinpara et al. |
| 9,481,438 | B1 | 11/2016 | Tuchscherer |
| 9,580,947 | B1 | 2/2017 | Amerling et al. |
| 9,587,601 | B1 | 3/2017 | Ochiai |
| D791,189 | S | 7/2017 | Scherer, III et al. |
| 9,694,892 | B1 | 7/2017 | Anschuetz et al. |
| 9,701,383 | B1 | 7/2017 | Stuber et al. |
| D794,078 | S | 8/2017 | Vaninetti |
| D794,079 | S | 8/2017 | Vaninetti et al. |
| 9,764,813 | B1 | 9/2017 | Zarembka et al. |
| 9,783,278 | B1 | 10/2017 | Dannenberg et al. |
| 9,789,945 | B1 | 10/2017 | Vaninetti et al. |
| 9,840,316 | B1 | 12/2017 | Jaszewski |
| D806,752 | S | 1/2018 | Vaninetti et al. |
| D807,920 | S | 1/2018 | Vaninetti |
| D809,017 | S | 1/2018 | Noda et al. |
| 9,868,501 | B1 | 1/2018 | Gable et al. |
| 9,926,064 | B1 | 3/2018 | Tuchscherer |
| D816,716 | S | 5/2018 | Abellera et al. |
| D832,472 | S | 10/2018 | Davis et al. |
| D834,617 | S | 11/2018 | Zin et al. |
| D834,618 | S | 11/2018 | Zin et al. |
| D835,675 | S | 12/2018 | Nakaura et al. |
| 10,155,578 | B1 | 12/2018 | Osthelder et al. |
| D842,504 | S | 3/2019 | Davis et al. |
| 10,246,173 | B1 | 4/2019 | Ingebritson |
| D852,230 | S | 6/2019 | Zin et al. |
| D852,848 | S | 7/2019 | Zin et al. |
| D852,849 | S | 7/2019 | Zin et al. |
| D852,850 | S | 7/2019 | Zin et al. |
| 10,343,759 | B2 | 7/2019 | Despineux |
| D859,469 | S | 9/2019 | Zin et al. |
| 10,507,898 | B1 | 12/2019 | Belter et al. |
| 10,578,042 | B2 | 3/2020 | Buis |
| D886,865 | S | 6/2020 | Bailey |
| 10,696,367 | B1 | 6/2020 | Ingebritson et al. |
| 10,723,429 | B1 | 7/2020 | Wiatrowski et al. |
| 10,787,236 | B1 | 9/2020 | Erickson |
| D911,296 | S | 2/2021 | Li |
| 10,940,917 | B2 | 3/2021 | Montague et al. |
| D917,565 | S | 4/2021 | Vaninetti et al. |
| 10,981,639 | B2 | 4/2021 | Kimpara et al. |
| 11,084,563 | B1 | 8/2021 | Pielow et al. |
| 11,097,824 | B1 | 8/2021 | Anderson, Jr. |
| 11,097,826 | B1 | 8/2021 | Dannenberg et al. |
| 11,186,352 | B1 | 11/2021 | Ingebritson et al. |
| 11,352,118 | B1 | 6/2022 | Dengel et al. |
| 11,597,486 | B1 * | 3/2023 | Pielow ..... H01H 13/06 |
| 11,628,919 | B1 | 4/2023 | Pielow et al. |
| 2002/0142680 | A1 | 10/2002 | Anderson |
| 2003/0024456 | A1 | 2/2003 | Swetish |
| 2003/0176121 | A1 | 9/2003 | Kitsu |
| 2003/0194927 | A1 | 10/2003 | Sanschagrin et al. |
| 2003/0232548 | A1 | 12/2003 | Alby et al. |
| 2004/0107789 | A1 | 6/2004 | Peppard |
| 2004/0121667 | A1 | 6/2004 | Okabe |
| 2004/0137806 | A1 | 7/2004 | Ohtsuki et al. |
| 2005/0262958 | A1 | 12/2005 | Kojima |
| 2006/0172631 | A1 | 8/2006 | Kameoka |
| 2007/0042652 | A1 | 2/2007 | Kitsu et al. |
| 2007/0197109 | A1 | 8/2007 | Yander |
| 2008/0038967 | A1 | 2/2008 | Shinde |
| 2008/0268729 | A1 | 10/2008 | Yomo et al. |
| 2009/0075534 | A1 | 3/2009 | Wiatrowski et al. |
| 2010/0147257 | A1 | 6/2010 | Yazaki et al. |
| 2011/0104963 | A1 | 5/2011 | Ellis |
| 2013/0280970 | A1 | 10/2013 | Clarkson et al. |
| 2014/0057508 | A1 | 2/2014 | Litjens et al. |
| 2014/0306505 | A1 | 10/2014 | Koch |
| 2016/0023740 | A1 | 1/2016 | Skrzypchak et al. |
| 2017/0043787 | A1 | 2/2017 | Mangette et al. |
| 2017/0306830 | A1 | 10/2017 | Bruestle et al. |
| 2019/0176952 | A1 | 6/2019 | Clark et al. |
| 2020/0156751 | A1 | 5/2020 | Skrzypchak et al. |
| 2020/0172220 | A1 | 6/2020 | Chung |
| 2021/0061431 | A1 | 3/2021 | McGinley |
| 2023/0102741 | A1 | 3/2023 | Fergus |
| 2023/0257091 | A1 | 8/2023 | Ahlswede |
| 2023/0257092 | A1 | 8/2023 | Ahlswede et al. |
| 2023/0257094 | A1 | 8/2023 | Jaszewski et al. |

FOREIGN PATENT DOCUMENTS

| | | |
|---|---|---|
| EP | 1101696 | 5/2001 |
| EP | 1400720 | 3/2004 |
| EP | 3326903 | 4/2019 |
| JP | S60 38293 | 2/1985 |
| JP | 3946315 | 7/2007 |
| JP | 4094151 | 6/2008 |
| JP | 2011-213215 | 10/2011 |
| JP | 2013-173423 | 9/2013 |
| JP | 5741259 | 7/2015 |
| JP | 5927980 | 6/2016 |
| WO | WO 2004-035381 | 4/2004 |

OTHER PUBLICATIONS

Erikson, et al., "Tiller Tilt Lock and Automatic Release System", Unpublished U.S. Appl. No. 16/257,380, filed Jan. 25, 2019 (specification and drawings only).

Mercury Marine, 15/20hp EFI Fourstroke Outboard Tiller, tiller handle, available at least as early as Nov. 17, 2017.

Mercury Marine, Big Tiller for 75-300 HP Mercury Outboards, tiller handle, available at least as early as 2018, admitted prior art.

Pielow et al., "Tiller for Outboard Motor," Unpublished U.S. Appl. No. 16/718,566, filed Dec. 18, 2019 (specification and drawings only).

Vaninetti et al, "Tiller for Outboard Motor," Unpublished U.S. Appl. No. 29/610,556, filed Jul. 13, 2017.

* cited by examiner

CONFIGURABLE SHIFT AND THROTTLE MECHANISM FOR TILLER OF MARINE DRIVE

FIELD

The present disclosure relates to marine drives, and more particularly, to tillers for marine drives having electric motors.

BACKGROUND

The Background is provided to introduce a foundation and selection of concepts that are further described below in the Detailed Description. The Background is not intended to identify key or essential features of the claimed subject matter, nor is it intended to be used as an aid in limiting the scope of the claimed subject matter.

U.S. Pat. No. 8,257,122 is directed to a multi-function throttle shaft that combines the motor speed-control and the motor direction-control in one tiller handle. Co-functionally, the throttle shaft is rotated clockwise/counterclockwise to control motor speed while intuitively allowing the user to push the throttle in for reverse direction and pull the throttle out for forward direction or vise-versa, based on whether the trolling motor is mounted on the transom or bow of a boat. In either case, the handle is always moved in the same direction that the operator wants the boat to travel.

U.S. Pat. No. 9,764,813 is directed to a tiller for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

U.S. Pat. No. 9,789,945 is directed to a tiller for an outboard motor. The tiller has a base bracket that is configured to be rotationally fixed with respect to the outboard motor, a chassis bracket that is coupled to the base bracket, and a locking arrangement. The locking arrangement is movable into and between a locked position, wherein the chassis bracket is locked to and rotates together with the base bracket, and an unlocked position, wherein the chassis bracket is freely rotatable with respect to the base bracket about a vertical axis when the tiller is in a horizontal position.

U.S. Pat. No. 10,246,173 is directed to a tiller for an outboard motor that has a manually operable shift mechanism configured to actuate shift changes in a transmission of the outboard motor amongst a forward gear, reverse gear, and neutral gear. The tiller also has a manually operable throttle mechanism configured to position a throttle of an internal combustion engine of the outboard motor into and between the idle position and a wide-open throttle position. An interlock mechanism is configured to prevent a shift change in the transmission out of the neutral gear when the throttle is positioned in a non-idle position. The interlock mechanism is further configured to permit a shift change into the neutral gear regardless of where the throttle is positioned.

U.S. Pat. No. 10,696,367 is directed to a tiller for an outboard motor that has a throttle grip that is manually rotatable through first and second ranges of motion into and between an idle position in which the outboard motor is controlled at an idle speed, and first and second open-throttle positions, respectively, in which the outboard motor is controlled at an above-idle speed. A throttle shaft is coupled to the throttle grip and is configured so that rotation of the throttle grip causes rotation of the throttle shaft, which changes a throttle position of a throttle of the outboard motor. A rotation direction switching mechanism is manually positionable into a first position in which rotation of the throttle grip through the first range of motion controls the throttle of the outboard motor and alternately manually positionable into a second position in which rotation of the throttle grip through the second range of motion controls the throttle position. Each of the above patents is hereby incorporated herein by reference in its entirety.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

According to an exemplary implementation of the present disclosure, a tiller system for a marine drive having an electric motor includes a tiller comprising a shift handle and a throttle grip configured to be rotated about a throttle axis to control a speed of the electric motor. The tiller system further includes a controller communicatively coupled to the throttle grip and the shift handle. The controller is configured to determine whether the tiller is in a separate handle mode or a throttle grip mode. Responsive to a determination that the tiller is in the throttle grip mode, the controller is configured to operate the electric motor such that a rotation of the throttle grip about the throttle axis controls a rotation direction of the electric motor.

According to another exemplary implementation of the present disclosure, a method for controlling an electric motor of a marine drive using a tiller having a shift handle and a throttle grip configured to be rotated about a throttle axis to control a speed of the electric motor is provided. The method includes determining whether the tiller is in a separate handle mode or a throttle grip mode. Responsive to a determination that the tiller is in the throttle grip mode, the method includes operating the electric motor such that a rotation of the throttle grip about the throttle axis controls a rotation direction of the electric motor.

According to yet another exemplary implementation of the present disclosure, a method for operating an electric motor of a marine drive is provided. The method includes providing a tiller system including a shift handle configured to be rotated about a shift axis to control a rotation direction of the electric motor and a throttle grip configured to be rotated about a throttle axis to control a speed of the electric motor. The method includes reconfiguring the tiller system such that a rotation of the throttle grip about the throttle axis controls the rotation direction of the electric motor.

According to yet another exemplary implementation of the present disclosure, a marine drive configured to propel a marine vessel is provided. The marine drive includes a propulsor, a tiller handle, a first control device on the tiller handle, a second control device on the tiller handle spaced apart from the first control device, and a controller configured to control a rotation direction and a rotation speed of the propulsor. The controller is operable in a first mode and a second mode. The first mode comprises control of the rotation direction of the propulsor according to input received at the first control device and control of the rotation speed of the propulsor according to input received at the second control device. The second mode comprises control of the rotation direction and the rotation speed of the propulsor according to input received at the second control device.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clearness and understanding. No unnecessary limitations are to be inferred therefrom beyond the requirement of the prior art because such terms are used for descriptive purposes only and are intended to be broadly construed.

A tiller for a marine drive (e.g., an outboard motor) comprises a throttle grip that is manually rotatable through a range of motion between a first position in which the marine drive is controlled at a zero propeller speed and a second position in which the marine drive is controlled at an above zero propeller speed. The transition to the use of electric motors in marine drives from internal combustion engines has enabled certain control and operational changes beyond the type of fuel required to operate the drive. For example, some operators of marine vessels prefer to operate the shift mechanism of the marine drive through use of a shift handle that is separate from and spaced apart the throttle grip of the tiller. Other operators of marine vessels prefer to operate the shift mechanism through rotation of the throttle grip alone such that rotation of the throttle grip in a first direction controls the drive to propel the vessel forwardly, and rotation of the throttle grip in a second direction opposite the first direction controls the drive to propel the vessel rearwardly.

Market research has shown that there is not an overwhelming consensus among which option operators prefer-rather, roughly half prefer the separate shift handle, and the other half prefer shifting via throttle grip. The present inventor has therefore recognized that providing a tiller that can easily accommodate either operator preference would be useful. Such accommodation of operator preference was not convenient when marine drives included internal combustion engines, as the shift and throttle handles were connected to mechanical shift and throttle cables that enabled shifting actions and changes in throttle position. Therefore, to transition between the separate handle and shift-in-throttle grip configurations, disconnection and reconnection of cables was required. Electric drives do not require such mechanical connections, as the motor direction and throttle of an electric drive are controlled electronically, thus the systems and methods of the invention described herein leverage this fact to accommodate the operator's tiller preference.

Figure 1:
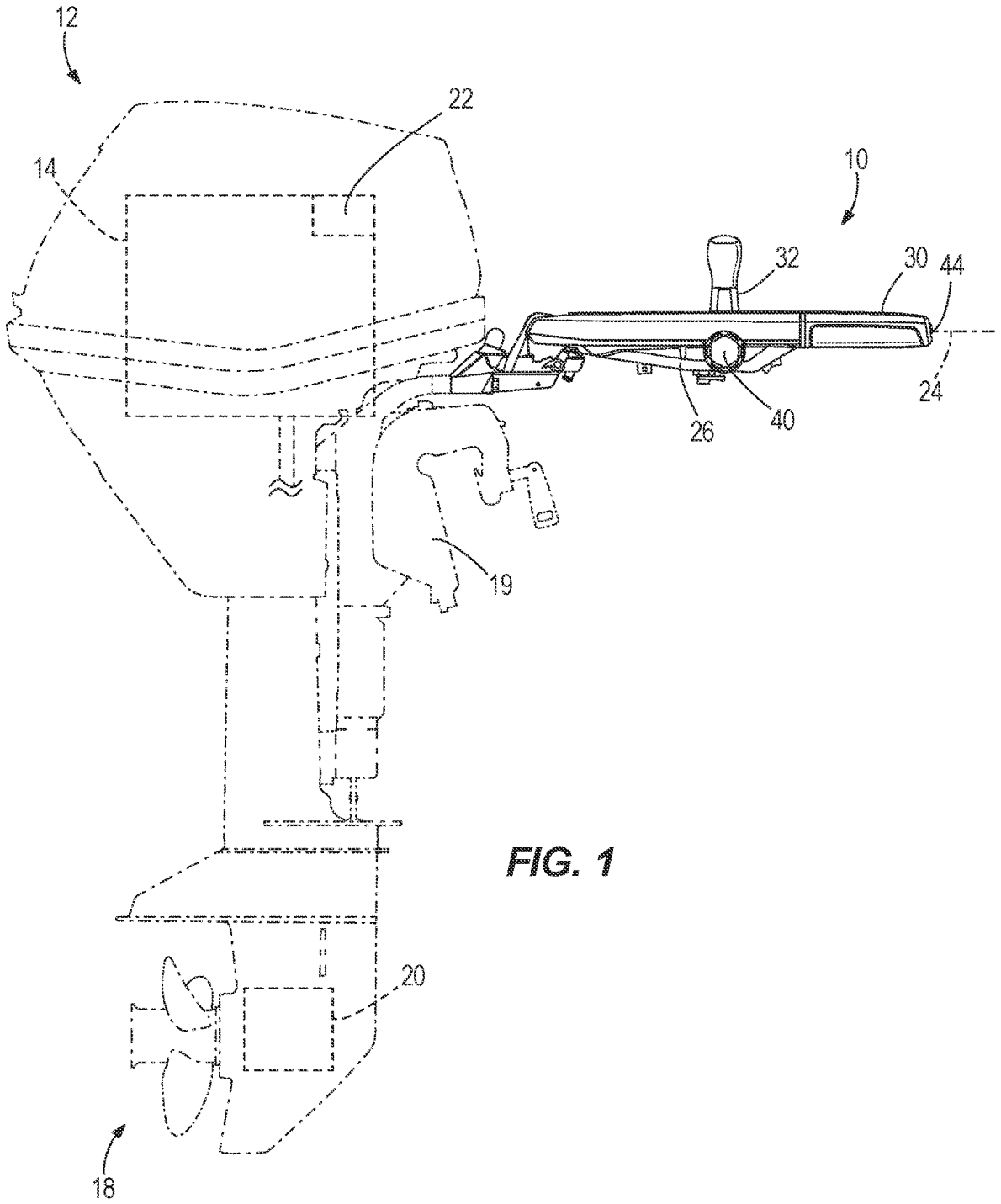
FIG. 1 depicts an exemplary embodiment of a tiller on an outboard marine drive having an electric motor.

FIG. 1 depicts an improved tiller 10 that provides manual control of a marine drive 12, represented herein as an outboard motor, on a marine vessel (not shown). The marine drive 12 includes a battery 14 that is configured to power an electric motor 20 that drives rotation of a propulsor (e.g., a propeller) 18. Because 4-stroke internal combustion engines can rotate in only one direction, previous marine drives required a reversing transmission to change the direction of rotation of a propeller and thereby produce thrusts in a forward or rearward direction based on operator commands received at the tiller assembly. By contrast, the direction of rotation of the electric motor 20 of the present disclosure can be governed by the direction of the current, thus producing thrusts in a forward or rearward direction by the propeller 18 without use of a reversing transmission. Although the present invention will be described with reference to an electric motor, in other embodiments, the marine drive 12 could include an internal combustion engine, or another type of propulsion technology.

Control of the various parameters of the electric motor 20 (e.g., motor speed, direction) is achieved by a propulsion control module (PCM) 22. As described in further detail below, the PCM 22 may be configured to receive signals from the tiller 10 and/or another controllers on the marine vessel. The PCM 22 may include memory and a programmable processor. As is conventional, the processor may be communicatively coupled to a computer-readable medium including volatile or non-volatile memory having computer-readable code stored thereon.

Figure 2:
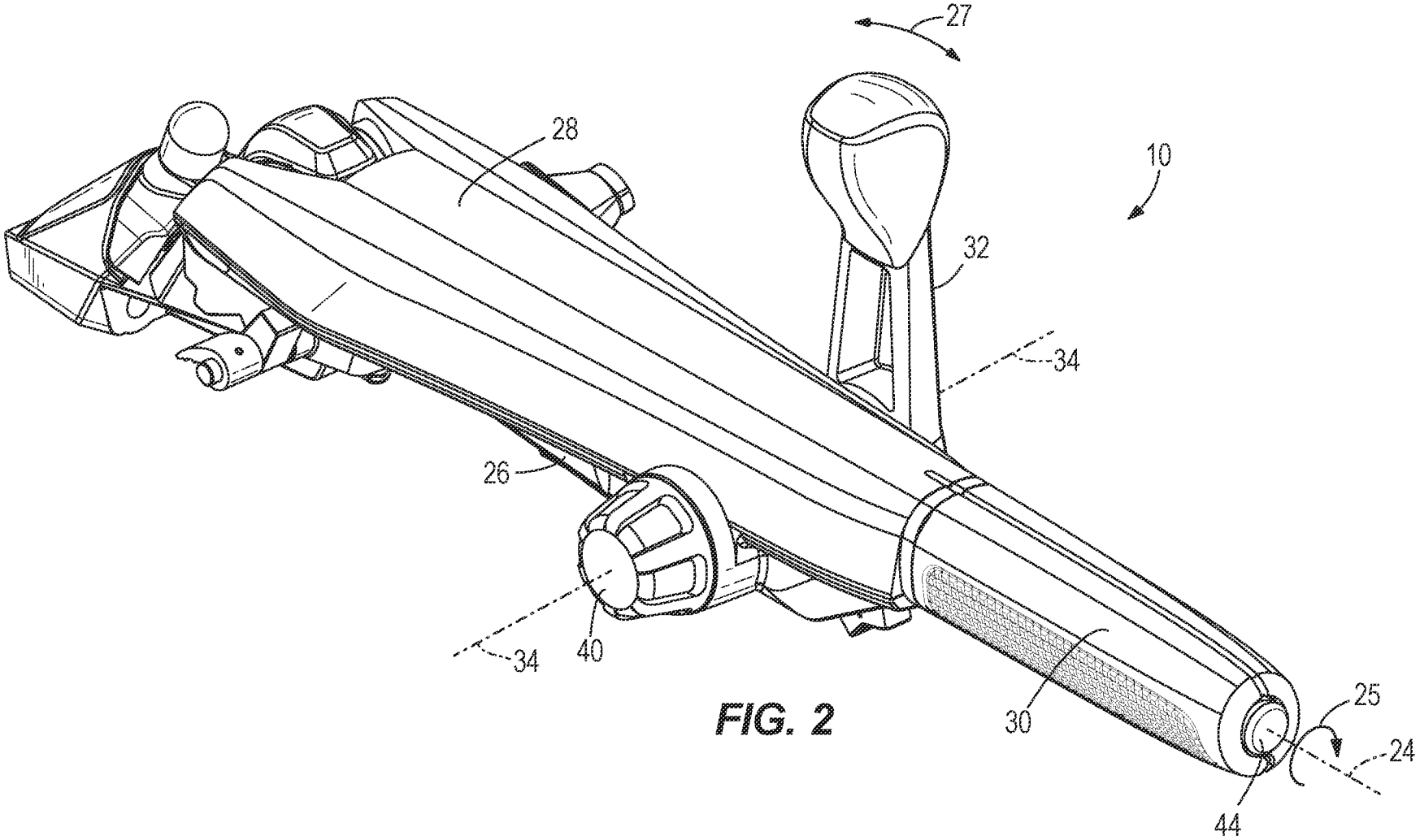
FIG. 2 depicts a configuration of the tiller of FIG. 1 featuring a shift handle that is separate from and spaced apart from a throttle grip.
Figure 3:
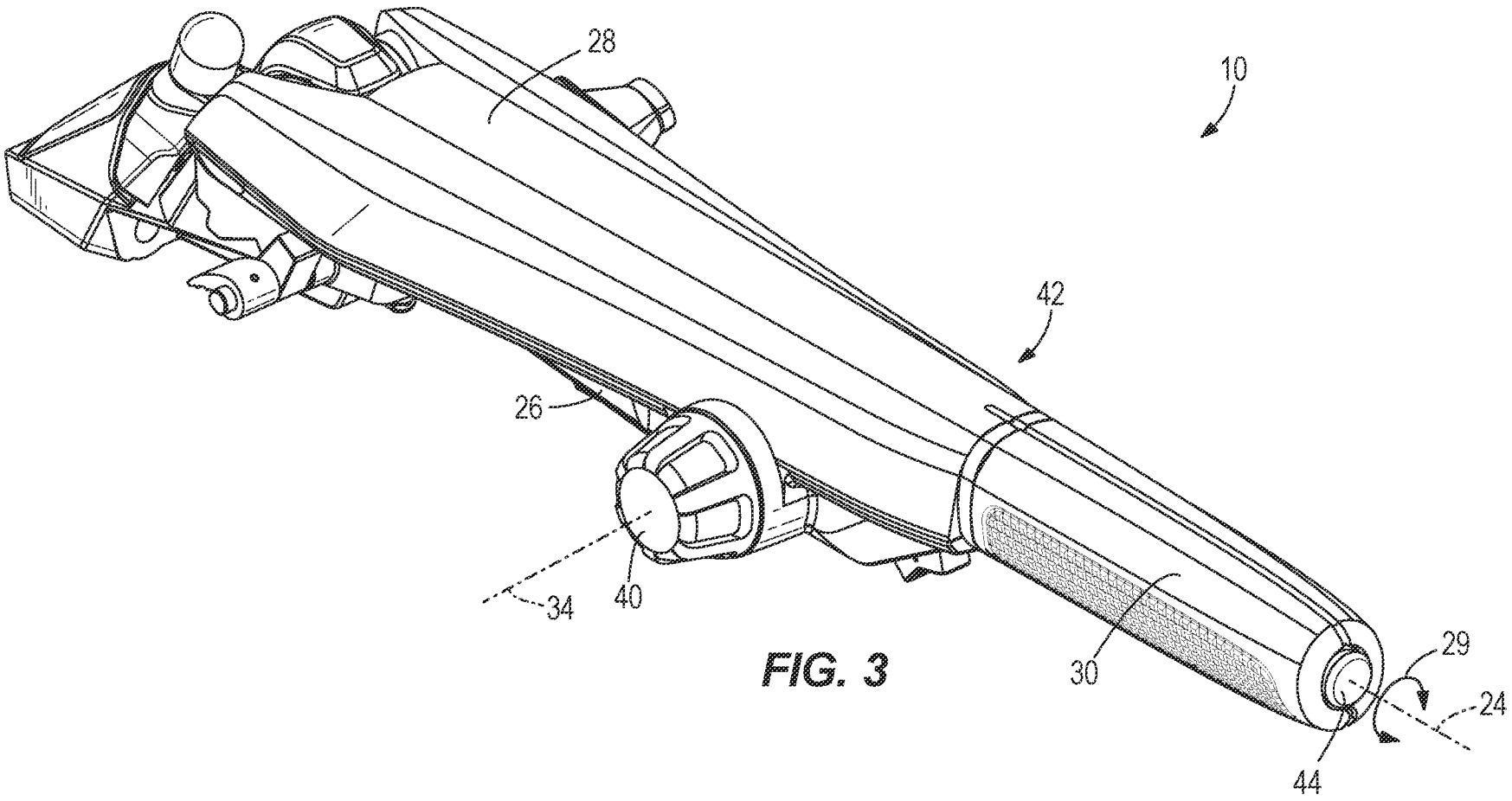
FIG. 3 depicts another configuration of the tiller of FIG. 1 featuring a single shift and throttle grip.

Referring now to FIGS. 2 and 3, the tiller 10 is shown to be elongated and having a base chassis 26, a top cover 28 and a throttle grip 30 that is manually rotatable about a throttle axis 24 (see arrow 25 of FIG. 2 and arrow 29 of FIG. 3) to receive operator input regarding the speed of the motor 20. In the separate shift handle and throttle grip configuration of the tiller depicted in FIG. 2 and described in further detail below, the tiller 10 includes a shift handle 32 that is manually pivotable about a shift handle axis 34 (see arrow 27) to thereby cause a change in rotation direction of the electric motor 20, resulting in forward or rearward thrust provided by the propeller 18. By contrast, in the throttle grip configuration depicted in FIG. 3, the shift handle 32 is removed and the attachment location of the shift handle 32 to the top cover 28 is replaced by a cap 42 (see also FIG. 6). The cap 42 may be configured to ensure the tiller 10 remains aesthetically pleasing in the throttle grip configuration and to keep water out of the internal components of the tiller by avoiding any open recesses in the base chassis 26 and/or top cover 28 in the tiller 10. The cap 42 may be coupled to the top cover 28 using any suitable permanent or non-permanent means (e.g., mechanical fasteners, adhesives, snap fit features).

The tiller 10 may optionally include a locking knob 40 that is rotatable around the axis 34 to manually lock a rotational position of the throttle grip 30 and thereby allow for hands-free operation of the throttle functionality of the tiller 10. The tiller 10 may further optionally include a kill switch 44 located at the free end of the throttle grip 30 for manually killing rotation of the electric motor 20.

Figure 6:
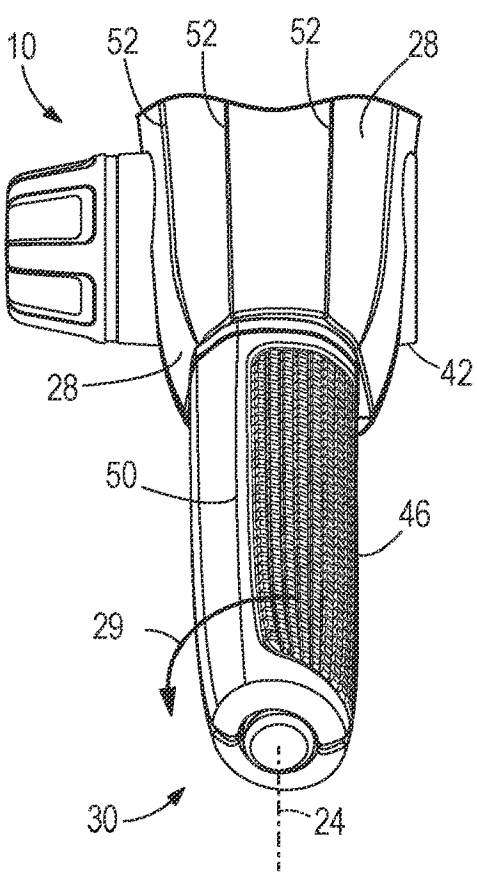
FIG. 6 depicts the tiller configuration of FIG. 3 with the throttle grip in a nonzero rearward drive setting.
Figure 5:
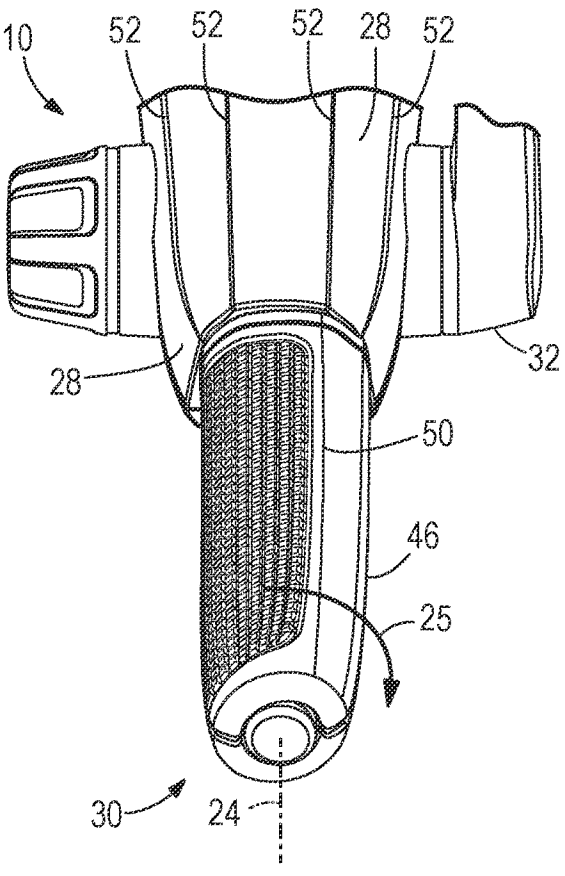
FIG. 5 depicts the tiller configuration of FIG. 2 with the throttle grip in a nonzero forward drive setting.
Figure 4:
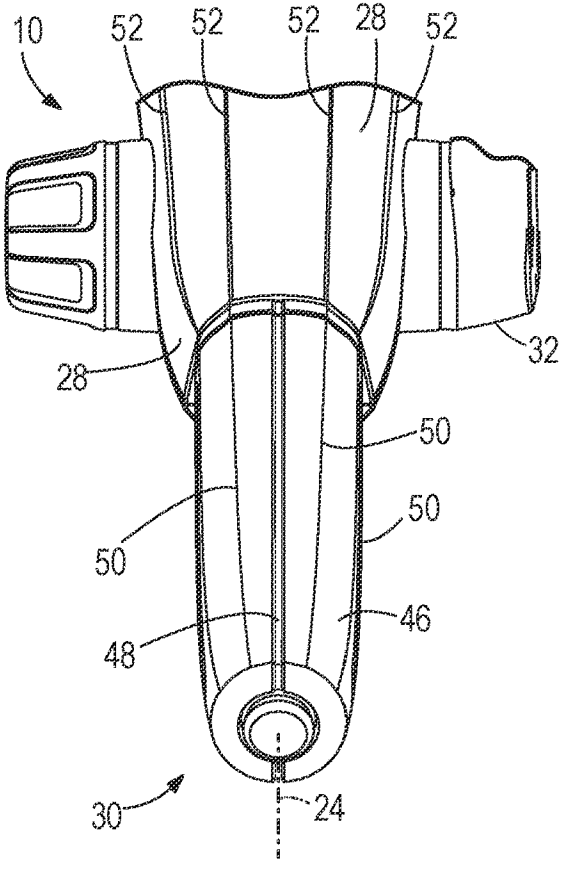
FIG. 4 depicts the tiller configuration of FIG. 2 with the throttle grip in a neutral position.

Turning now to FIGS. 4-6, operation of the tiller 10 to control the electric motor 20 in both the separate handle and throttle grip configurations is depicted. FIG. 4 depicts the separate handle configuration of FIG. 2 when the throttle grip 30 is at a neutral or zero position and the electric motor 20 is either not rotating or is rotating at a very low speed. In the exemplary embodiments depicted in FIGS. 4-6, the throttle grip 30 is shown to include a throttle grip body 46 with a main indicator 48 and secondary indicators 50 in the form of longitudinal ribs and/or longitudinal channels that provide the operator with visual and/or tactile feedback to distinguish when the throttle grip 30 is in the neutral position (FIG. 4) or away from the neutral position (FIGS. 5 and 6). The main indicator 48 and secondary indicators 50 are configured to align with similar indicators 52 provided on the top cover 28.

Still referring to the separate handle tiller configuration, FIG. 5 depicts rotation of the throttle grip 30 in a clockwise direction away from the neutral position as indicated by arrow 25. The amount of rotation of the throttle grip 30 corresponds to the speed of the motor 20 with a maximum amount of rotation corresponding to a maximum operating speed of the motor 20. In the separate handle configuration of FIG. 5, the direction of rotation of the throttle grip 30 does not determine the direction of thrust generated by the propeller 18. Only a single direction of rotation away from the neutral position is utilized to control the speed of the motor, and the direction of thrust provided by the propeller 18 is determined by the position of the shift handle 32.

Figure 7:
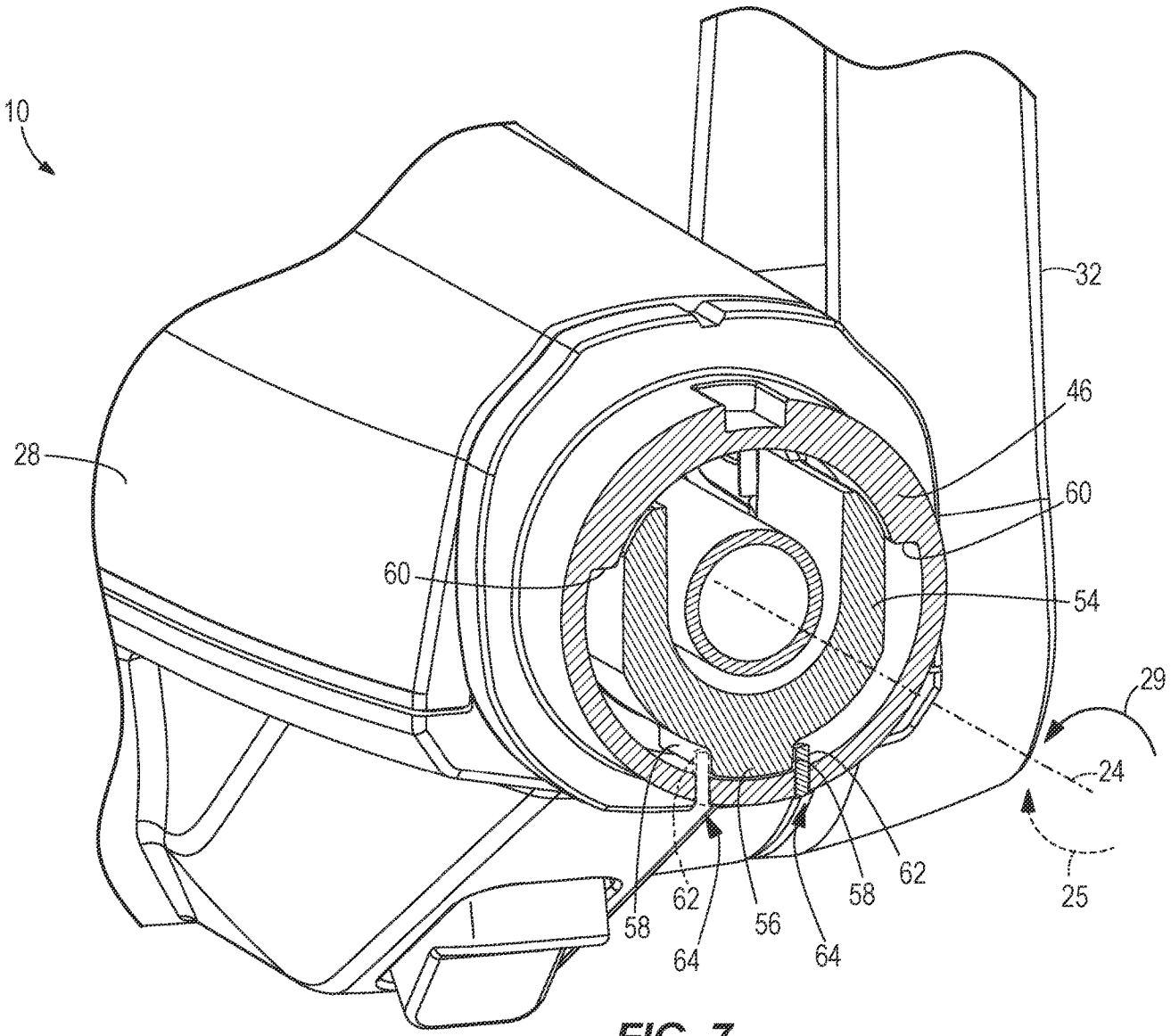
FIG. 7 depicts a cross-sectional view of the tiller configuration of FIG. 2.

As shown in the cross-sectional view of FIG. 7, the internal components of the tiller 10 include a tiller chassis 54 that is co-axial with and disposed within the throttle grip body 46 to support rotation of the throttle grip body 46. Engagement surfaces 60 are shown to be formed in an interior region of the throttle grip body 46. The engagement surfaces 60 are configured to contact engagement surfaces 58 of an engagement tab portion 56 of the tiller chassis 54 to restrain rotation of the throttle grip body 46. Additional rotation restriction components, in the form of removable pins 62 inserted through holes 64 formed in the throttle grip body 46, may further limit rotation of the throttle grip body 46 relative to the tiller chassis 54, and thus rotation of the throttle grip 30 itself. The location of the pin 62 may enable the throttle grip 30 for right hand or left hand operation in the separate handle tiller configuration. For example, when the pin 62 is located on the right side of the engagement tab portion 56, as is shown in FIG. 7, the throttle grip body 46 is free to rotate relative to the tiller chassis 54 in a counterclockwise direction (i.e., left hand operation) as indicated by arrow 29, but cannot rotate in the clockwise direction. When the pin 62 is located on the left side of the engagement tab portion 56 as shown in phantom lines in FIG. 7, the throttle grip body 46 is free to rotate relative to the tiller chassis 54 in a clockwise direction (i.e., right hand operation) as indicated by arrow 25, but cannot rotate in the counterclockwise direction.

Returning to the embodiment depicted in FIG. 5, the permitted direction of rotation away from the neutral position is shown to be clockwise, as such operation is most comfortable for right handed operators. However, in other embodiments of the separate handle tiller configuration, the throttle grip 30 may be configured to rotate away from the neutral position in a counterclockwise direction to accommodate left handed operators.

FIG. 6 depicts operation of the throttle grip 30 to control both the speed and direction of the electric motor 20. When the shift handle 32 is removed and replaced by the cap 42 in the throttle grip tiller configuration, the pin member is likewise removed to permit the throttle grip 30 to rotate in both the clockwise and counterclockwise directions away from the neutral position such that rotation in a first direction (e.g., clockwise) results in rotation of the electric motor 20 in a first direction and a forward thrust generated by the propeller 18, up to a maximum operational motor speed. Rotation in a second direction (e.g., counterclockwise, as depicted by arrow 29) results in rotation of the electric motor 20 in a second direction and a reverse thrust generated by the propeller 18, up to a maximum operational motor speed. As described above with reference to FIG. 5, such rotation directions may be configurable by an operator. For example, a left handed operator may prefer rotation away from the neutral position in a counterclockwise direction to correspond with thrust in a forward direction, and rotation away from the neutral position in a clockwise direction to correspond with thrust in a reverse direction.

Figure 8:
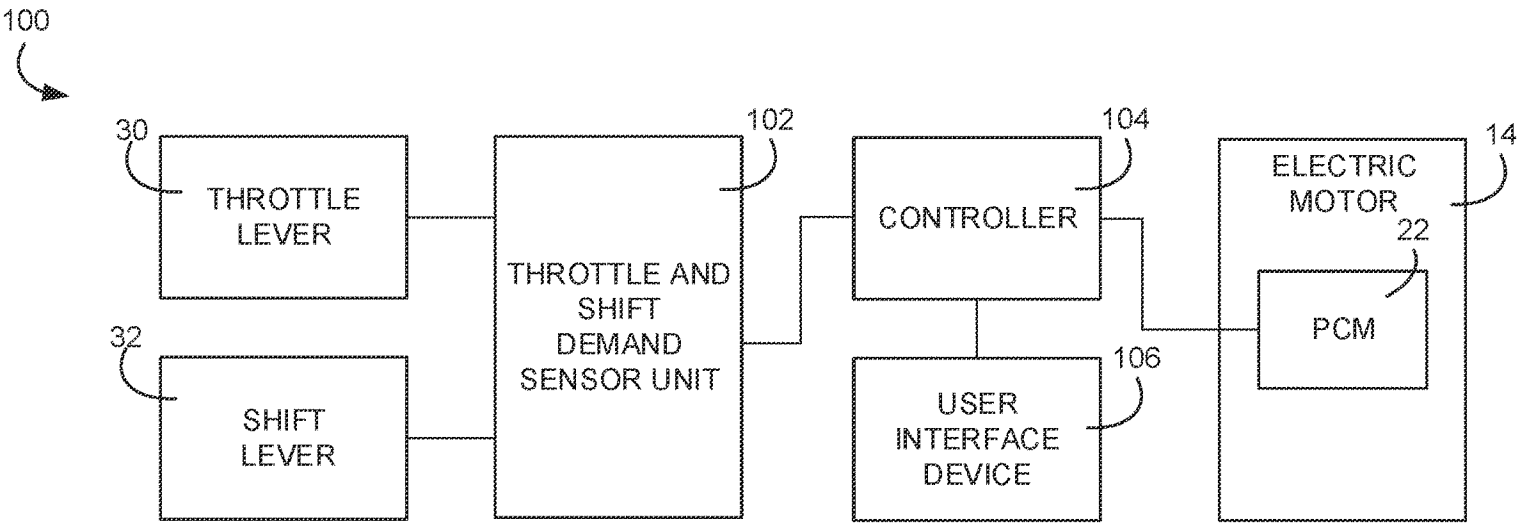
FIG. 8 depicts a block diagram of the tiller configuration of FIG. 2.
Figure 9:
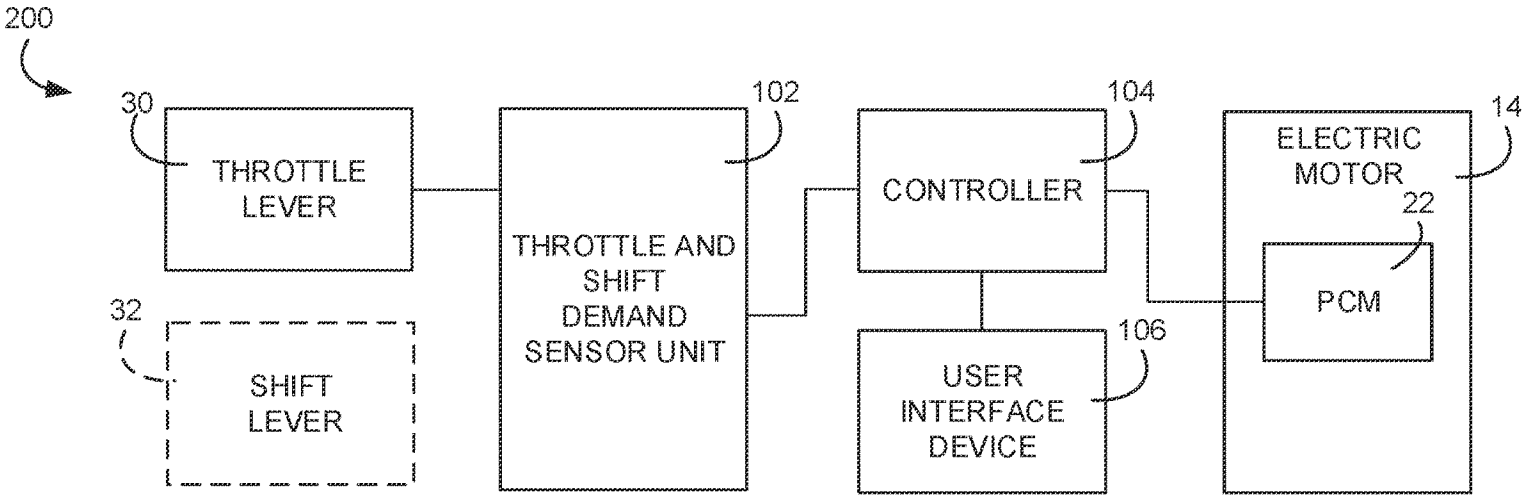
FIG. 9 depicts a block diagram of the tiller configuration of FIG. 3.

Referring now to FIGS. 8 and 9, block diagrams of the separate handle and throttle grip tiller configurations 100, 200 are respectively depicted. As shown, in the separate handle configuration 100, both the throttle grip 30 and shift handle 32 are communicatively coupled to a throttle and shift demand sensor unit 102 that may be housed within the tiller 10 or elsewhere in the marine vessel. In the throttle grip tiller configuration 200, the shift handle 32 is removed and only the throttle grip 30 provides signal input to the throttle and shift demand sensor unit 102. The throttle and shift demand sensor unit 102 may include any types of sensors (e.g., potentiometers) that detect the positions of the throttle grip 30 and/or shift handle 32 and translate such positions into an electrical signal input for the controller 104.

The controller 104 may include a processor configured to execute software stored in memory. The executed software may depend on user inputs regarding the configuration of the tiller (e.g., separate handle or configuration, right or left hand throttle operation). The user inputs are received from a user interface device 106. In various embodiments, the user interface device 106 could include a multifunction touch screen display or keypad mounted on the marine vessel, a smartphone device configured to communicate with the controller, or another input device utilized when servicing the marine vessel (e.g., an input device configured to run the Mercury Computer Diagnostic System G3). For example, if a user removes the shift handle 32 and enters an input indicating that the tiller is in the throttle grip configuration, the controller 104 may be programmed to ignore false input from the throttle and shift demand sensor unit 102 indicating a position of the shift handle 32. Similarly, if a user enters an input indicating that the tiller is in the separate handle configuration with right hand throttle operation, the controller 104 may be programmed to ignore false input from the throttle and shift demand sensor unit 102 indicating that the throttle grip 30 has been rotated in accordance with left hand operation that is not physically achievable by the throttle grip 30 due to the presence of a restriction device (e.g., pin 62, see FIG. 7). Based on the signals received from the sensor unit 102, user input received from the user interface device 106, and commands generated by the controller 104, the PCM 22 operates the speed and direction of the electric motor 20.

Figure 10:
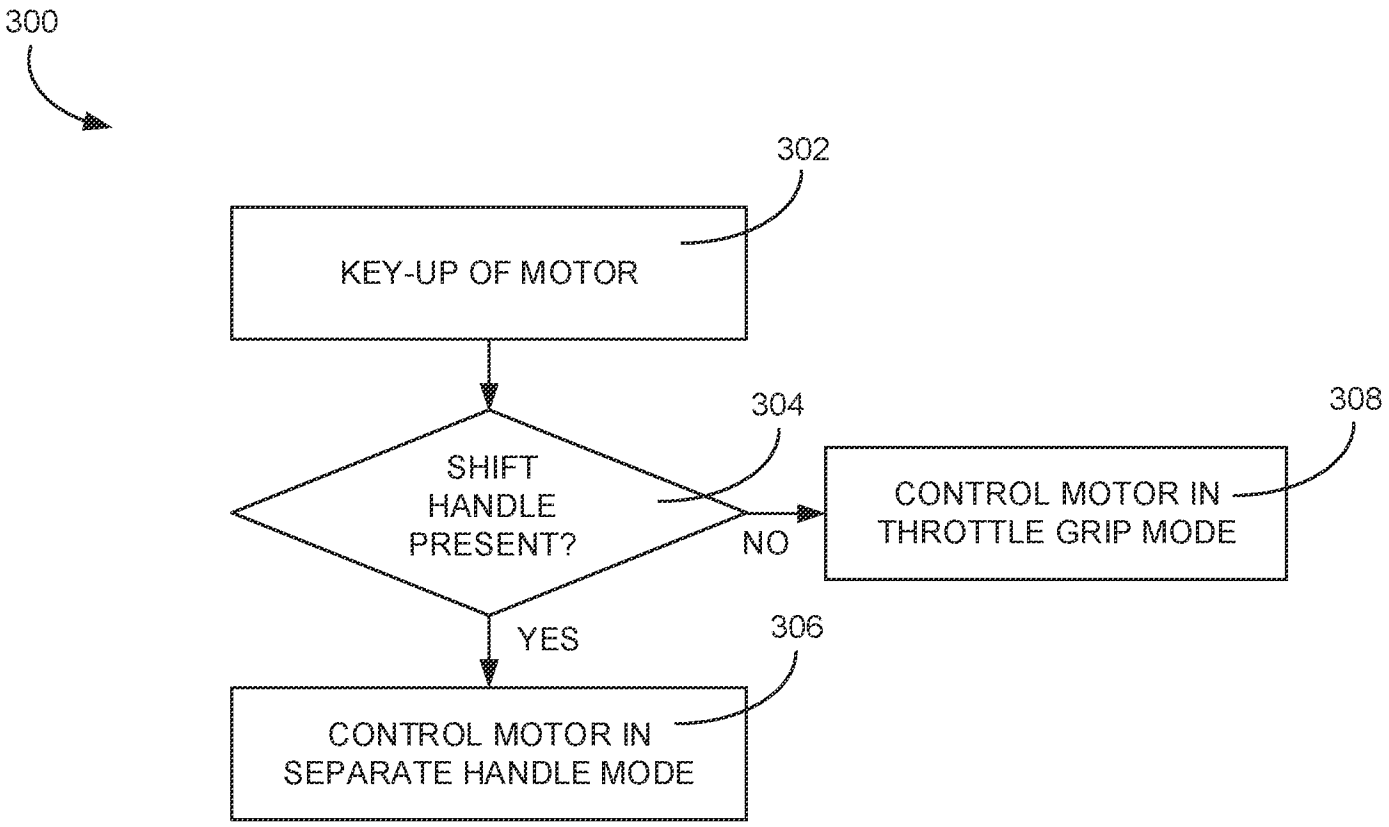
FIG. 10 depicts a flow chart of a process for operating the marine drive of FIG. 1 using either the tiller configuration of FIG. 2 or FIG. 3.

Referring now to FIG. 10, a flow chart of a process 300 for controlling the electric motor 20 is depicted. In an exemplary embodiment, process 300 is performed at least in part by the PCM 22. Process 300 commences with key-up of the motor 20 (step 302). During key-up, the motor 20 is not rotating, but the PCM 22 is powered by a battery and certain other sensors coupled to the PCM 22 may be operational. Continuing with step 304, the PCM 22 determines if the shift handle 32 is coupled to the tiller 10. This determination may be based on the presence or absence of a signal generated by the sensor unit 102 indicating the position of the shift handle 32. In other embodiments, this determination may be based on input at the user interface device 106 indicating the presence or absence of the shift handle 32.

If, at step 304, the PCM 22 determines that the shift handle 32 is detected on the tiller 10, the PCM 22 operates the electric motor 20 in the separate handle mode at step 306. In such a mode, the sensor unit 102 and/or the PCM 22 may ensure that demand signals regarding the direction and speed of the motor are originating from the throttle grip 30 and the shift handle 32 separately. The PCM 22 may further ensure that any clearly erroneous signals are ignored (e.g., a signal originating from the throttle grip 30 of FIG. 5 indicating that the grip has been rotated in a counterclockwise direction away from the neutral position). If, however, at step 304 the PCM 22 determines that the shift handle 32 is not present, the PCM 22 controls the motor 20 in the throttle grip mode, controlling the direction and speed of the motor 20 only according to signals originating from the throttle grip 30.

In the present disclosure, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A tiller system for a marine drive having an electric motor, the tiller system comprising:

a tiller comprising a shift handle and a throttle grip configured to be rotated about a throttle axis to control a speed of the electric motor; and a controller communicatively coupled to the throttle grip and the shift handle, wherein the controller is configured to:

determine whether the tiller is in a separate handle mode or a throttle grip mode; and responsive to a determination that that the tiller is in the throttle grip mode, operate the electric motor such that a rotation of the throttle grip about the throttle axis controls a rotation direction of the electric motor.

2. The tiller system of claim 1, wherein operating the electric motor such that a rotation of the throttle grip about the throttle axis controls the rotation direction of the electric motor comprises rotating the throttle grip through a first range of motion from a neutral position to a first maximum speed position in a first rotation direction and through a second range of motion from a neutral position to a second maximum speed position in a second rotation direction.

3. The tiller system of claim 2, wherein the first range of motion is separate and distinct from the second range of motion.

4. The tiller system of claim 2, wherein the first range of motion is oppositely oriented with respect to the second range of motion.

5. The tiller system of claim 1, wherein the controller is further configured to operate the electric motor such that a position of the shift handle controls a rotation direction of the electric motor responsive to a determination that the tiller is in the separate handle mode.

6. The tiller system of claim 1, wherein the determination that the tiller is in the separate handle mode or the throttle grip mode is based on a user input received at a user interface device that is communicably coupled to the controller.

7. The tiller system of claim 6, wherein the user input further comprises selection of right hand operation or left hand operation of the throttle grip.

8. The tiller system of claim 1, wherein the shift handle is detachable from the tiller.

9. A method for controlling an electric motor of a marine drive using a tiller comprising a shift handle and a throttle grip configured to be rotated about a throttle axis to control a speed of the electric motor, the method comprising:

determining whether the tiller is in a separate handle mode or a throttle grip mode; and responsive to a determination that the tiller is in the throttle grip mode, operating the electric motor such that a rotation of the throttle grip about the throttle axis controls a rotation direction of the electric motor.

10. The method of claim 9, wherein operating the electric motor such that a rotation of the throttle grip about the throttle axis controls the rotation direction of the electric motor comprises rotating the throttle grip through a first range of motion from a neutral position to a first maximum speed position in a first rotation direction and through a second range of motion from a neutral position to a second maximum speed position in a second rotation direction.

11. The method of claim 10, wherein the first range of motion is separate and distinct from the second range of motion.

12. The method of claim 10, wherein the first range of motion is oppositely oriented with respect to the second range of motion.

13. The method of claim 9, wherein the method further comprises:

responsive to a determination that the tiller is in the separate handle mode, operating the electric motor such that a position of the shift handle controls a rotation direction of the electric motor.

14. The method of claim 9, wherein the determination whether the tiller is in the separate handle mode or the throttle grip mode is based on a user input received at a user interface device.

15. The method of claim 14, wherein the user input further comprises selection of right hand operation or left hand operation of the throttle grip.

16. A method for operating an electric motor of a marine drive, the method comprising:

providing a tiller system comprising a shift handle configured to be rotated about a shift axis to control a rotation direction of the electric motor and a throttle grip configured to be rotated about a throttle axis to control a speed of the electric motor; and reconfiguring the tiller system such that a rotation of the throttle grip about the throttle axis controls the rotation direction of the electric motor.

17. The method of claim 16, wherein reconfiguring the tiller system comprises detaching the shift handle from the tiller system.

18. The method of claim 17, wherein reconfiguring the tiller system further comprises coupling a cap to the tiller system to cover a recess formed by detachment of the shift handle.

19. The method of claim 16, wherein reconfiguring the tiller system comprises removing a restriction device configured to restrain rotation of the throttle grip.

20. The method of claim 19, wherein the restriction device is a pin.

21. The method of claim 16, wherein reconfiguring the tiller system comprises receiving a user input from a user interface device.

22. The method of claim 21, wherein the user input further comprises selection of right hand operation or left hand operation of the throttle grip.

23. A marine drive configured to propel a marine vessel, the marine drive comprising:

a propulsor;

a tiller handle;

a first control device on the tiller handle;

a second control device on the tiller handle spaced apart from the first control device; and a controller configured to control a rotation direction and a rotation speed of the propulsor and operable in a first mode and a second mode;

wherein the first mode comprises control of the rotation direction of the propulsor according to input received at the first control device and control of the rotation speed of the propulsor according to input received at the second control device; and wherein the second mode comprises control of the rotation direction and the rotation speed of the propulsor according to input received at the second control device.

24. The marine drive of claim 23, wherein the input received at the second control device in the second mode comprises rotation of the second control device away from a neutral position in both a first direction and a second direction opposite the first direction.

25. The marine drive of claim 24, wherein the input received at the second control device in the first mode comprises rotation of the second control device away from the neutral position in only the first direction.

26. The marine drive of claim 24, wherein the first direction corresponds with forward propulsion of the marine vessel and the second direction corresponds with rearward propulsion of the marine vessel.

27. The marine drive of claim 23, wherein the first control device comprises a lever and wherein the second control device comprises a rotatable grip.

* * * * *